US008342078B2

(12) United States Patent
Neuner

(10) Patent No.: US 8,342,078 B2
(45) Date of Patent: Jan. 1, 2013

(54) RECIPROCATING-PISTON PUMP FOR FEEDING A LIQUID

(75) Inventor: Heiko Neuner, Hollfeld (DE)

(73) Assignee: Webasto SE, Strockdorf (DE)

( * ) Notice: Subject to any disclaimer, the term of this patent is extended or adjusted under 35 U.S.C. 154(b) by 1147 days.

(21) Appl. No.: 12/133,107

(22) Filed: Jun. 4, 2008

(65) Prior Publication Data

US 2008/0314238 A1 Dec. 25, 2008

(30) Foreign Application Priority Data

Jun. 19, 2007 (DE) ..... 10 2007 028 059

(51) Int. Cl.
*F01B 11/02* (2006.01)

(52) U.S. Cl. ..... 92/85 R; 417/417

(58) Field of Classification Search ..... 92/85 R, 92/85 A, 85 B, 143; 417/416, 417
See application file for complete search history.

(56) References Cited

U.S. PATENT DOCUMENTS

| | | | | |
|---|---|---|---|---|
| 4,775,301 | A * | 10/1988 | Cartwright et al. | 417/417 |
| 5,509,792 | A * | 4/1996 | Sullivan et al. | 92/85 R |
| 5,921,758 | A * | 7/1999 | Anamoto et al. | 417/416 |
| 6,295,662 | B1 * | 10/2001 | Idland et al. | 417/418 |
| 6,722,862 | B2 * | 4/2004 | Hartnagel et al. | 417/417 |

FOREIGN PATENT DOCUMENTS

| | | |
|---|---|---|
| DE | 1966459 | 1/1973 |
| DE | 4205290 A1 | 8/1993 |
| DE | 9312752 U1 | 12/1993 |
| DE | 10227659 | 1/2004 |
| DE | 102005025505 | 12/2006 |

OTHER PUBLICATIONS

English translation of DE 102007028059.0 filed Jun. 4, 2008.
European Search Report EP 08 00 9795.

* cited by examiner

*Primary Examiner* — Michael Leslie
(74) *Attorney, Agent, or Firm* — Fitch Even Tabin & Flannery LLP

(57) ABSTRACT

A reciprocating-piston pump having an electromagnetically driveable reciprocating piston, which is mounted with a restoring spring, for feeding a liquid, an impact damper composed of an elastomer for damping an impact of the reciprocating piston at the end of a feed phase, a core flange which is situated opposite the reciprocating piston, with a gap which is dependent on the position of the reciprocating piston being provided between the reciprocating piston and the core flange. The kinetic energy of the reciprocating piston during an early feed interval of a feed phase is absorbed primarily by the restoring spring and the feed of the liquid, and in that the kinetic energy of the reciprocating piston during a late feed interval of a feed phase is absorbed primarily by the hydraulic damping of the liquid present in the gap.

7 Claims, 2 Drawing Sheets

RECIPROCATING-PISTON PUMP FOR FEEDING A LIQUID

This invention relates to and claims the benefit of priority from German Patent Application No.: DE 10 2007 028 059.0, filed Jun. 19, 2007.

The invention relates to a reciprocating-piston pump having an electromagnetically driveable reciprocating piston, which is mounted with a restoring spring, for feeding a liquid, an impact damper composed of an elastomer for damping an impact of the reciprocating piston at the end of a feed phase, a core flange which is situated opposite the reciprocating piston, with a gap which is dependent on the position of the reciprocating piston being provided between the reciprocating piston and the core flange.

Reciprocating-piston pumps are used for example for supplying a motor vehicle heater with liquid fuel. Said reciprocating-piston pumps can feed a defined quantity of a liquid, for example fuel, per unit time. In this way, when used in a motor vehicle heater, it is possible to obtain stable operation with a simultaneous output of a desired heat quantity.

In the interior of the reciprocating-piston pump, a reciprocating piston moves back and forth periodically in the axial direction, and feeds a precisely defined quantity of a liquid, for example fuel, with each period. As the oscillating reciprocating piston impacts in its end positions, a "clattering" impact noise is generated, for which reason modern reciprocating-piston pumps are optimized not only with regard to precise metering of the feed quantity but also with regard to the working noise generated. The impact noise when the respective axial end positions of the reciprocating piston are reached is reduced by means of so-called impact dampers which absorb the movement energy of the reciprocating piston. Said impact dampers are typically composed of an elastomer.

It is disadvantageous here that elastomers harden at low temperatures below their glass transition temperature, as a result of which the impact noise of the piston is intensified since its impact energy can no longer be absorbed as effectively.

DE 1 966 459 A describes a pump for feeding a liquid in which the impact dampers are realized by utilizing the compressibility of liquid cushions of the fed liquid.

DE 10 2005 025 505 A1 describes a device for damping the end impact of a hydraulic cylinder with a liquid cushion.

However, such damping arrangements which are effective even at low temperatures require comparatively complex design measures, such that it can be a fundamental aim to adhere to the damping principle using elastomers.

The object of the invention consists in refining the generic reciprocating-piston pump in such a way as to avoid the problem explained above and such that low-noise feeding of a liquid is possible even at temperatures below the glass transition temperature of the impact damper.

Said object is achieved by means of the features of the independent claims.

Advantageous embodiments and refinements of the invention can be gathered from the dependent claims.

The reciprocating-piston pump builds on the generic prior art in that the kinetic energy of the reciprocating piston during an early feed interval of a feed phase is absorbed primarily by the restoring spring and the feed of the liquid, and in that the kinetic energy of the reciprocating piston during a late feed interval of a feed phase is absorbed primarily by the hydraulic damping of the liquid present in the gap. If the temperature in the interior of the reciprocating-piston pump is below the glass transition temperature of the impact damper, then the elasticity of the impact damper is greatly restricted. In this state, the impact damper is no longer capable of absorbing the kinetic energy of the reciprocating piston at the end of the feed phase. The fed liquid can be utilized to absorb a part of the kinetic energy of the reciprocating piston in a late feed interval of the feed phase, by means of a liquid cushion which brakes the movement of the reciprocating piston in the reciprocating-piston pump. Here, the liquid cushion imparts a hydraulic damping action to the reciprocating piston and ideally builds up its damping action only shortly before the end stop is reached, so as not to adversely affect the working cycle of the reciprocating-piston pump. The liquid cushion is generated if, in the late feed interval of the teed phase, liquid is pressed through between the reciprocating piston and the core flange shortly before the end position is reached. This means that the impact damper composed of elastomer need absorb less kinetic energy of the reciprocating piston, since a part of the kinetic energy of the reciprocating piston is absorbed by the hydraulic damping of the liquid present in the gap between the reciprocating piston and the core flange. This leads to a measurable noise reduction of the impact noise of the oscillating reciprocating piston at low temperatures, and is a simple, cost-effective design measure for which no additional components are required.

The flow optimization can advantageously be provided in that the gap provided between the core flange and reciprocating piston is minimized in order to build up the hydraulic damping for braking the reciprocating piston before the latter comes into contact with the impact damper at its end stop at the end of the feed phase. "Minimizing" means reducing the gap dimension to a value which still prevents contact between the reciprocating piston and the core flange taking production tolerances into consideration. Conventionally, a liquid-filled gap is present between the core flange and the reciprocating piston in all positions of the reciprocating piston, which liquid-filled gap prevents a form-fitting connection between the reciprocating piston and the core flange. The minimum spacing between the core flange and the reciprocating piston at the end of the feed phase is dimensioned generously, which offers the advantage of a high production tolerance. If the gap dimension is reduced, then a smaller production tolerance is necessary. If the reciprocating piston approaches the core flange, then the reciprocating piston displaces the liquid present in said region. The displaced liquid must flow through the gap between the core flange and the reciprocating piston, which gap reaches its minimum extent when the end stop is reached at the end of the feed phase. As the cross-sectional area of the gap becomes smaller, in a plane perpendicular to the movement direction of the reciprocating piston, an increasing hydraulic damping action is built up, which dominates the absorption of kinetic energy of the reciprocating piston during a late feed interval of a feed phase when the gap becomes narrow enough. It should be noted in particular that the effect of hydraulic damping is dependent inter alia on the viscosity of the liquid and therefore increases with falling temperature.

It can expediently be provided that an impact damper composed of elastomer is provided for impact damping of the reciprocating piston at the end of a replenishing phase. For structural reasons, the reciprocating piston reaches two end stop points during its oscillating movement. The impact of the reciprocating piston at the end of the replenishing phase would, if not damped, likewise contribute to an undesired generation of noise of the reciprocating-piston pump. A sufficiently dimensioned O-ring composed of elastomer is therefore inserted for impact damping at the stop point at the end of the replenishing phase, which O-ring can absorb the impact energy of the reciprocating piston. More installation space is available at said stop point of the reciprocating-piston pump, as a result of which a larger impact damper can be used which, even at temperatures below the glass transition temperature of the elastomer, absorbs sufficient movement energy of the reciprocating piston to ensure low-noise operating of the reciprocating-piston pump.

It can advantageously be provided that a damping element which comprises an elastomer is provided for damping pulsations generated in a feed line by the reciprocating-piston pump. The oscillating movement of the reciprocating piston and the associated pulsed feed action can cause undesired pulsations to be generated in a feed line. In the extreme case, said pulsations are even capable of preventing stable operation of the units, for example of a motor vehicle heater, which are supplied with the fed liquid.

In order to utilize the effect of hydraulic damping, it is expediently provided that the gap width between the reciprocating piston and the core flange in the radial direction perpendicular to the axial movement direction of the reciprocating piston at the end of the feed phase is between 1.0 and 0.1 mm. Since the intensity of the hydraulic damping increases with falling gap width, a narrower gap ensures more intense hydraulic damping. Here, the lower limit for the gap width is defined by the manufacturing fluctuations which occur during production, since a form-fitting connection between the reciprocating piston and the core flange should be prevented. An expedient upper limit for the gap width is defined by the required intensity of the hydraulic damping and is influenced by the respective design of the reciprocating-piston pump. For example, a different mass of the reciprocating piston is relevant in different designs.

It is preferably provided that the gap width between the reciprocating piston and core flange in the radial direction perpendicular to the axial movement direction of the reciprocating piston at the end of the feed phase is between 0.5 and 0.3 mm.

The reciprocating-piston pump can expediently be provided in the feed line of a motor vehicle heater for feeding liquid fuel.

One preferred embodiment of the invention is explained by way of example below on the basis of the drawings, in which.

Figure 1:
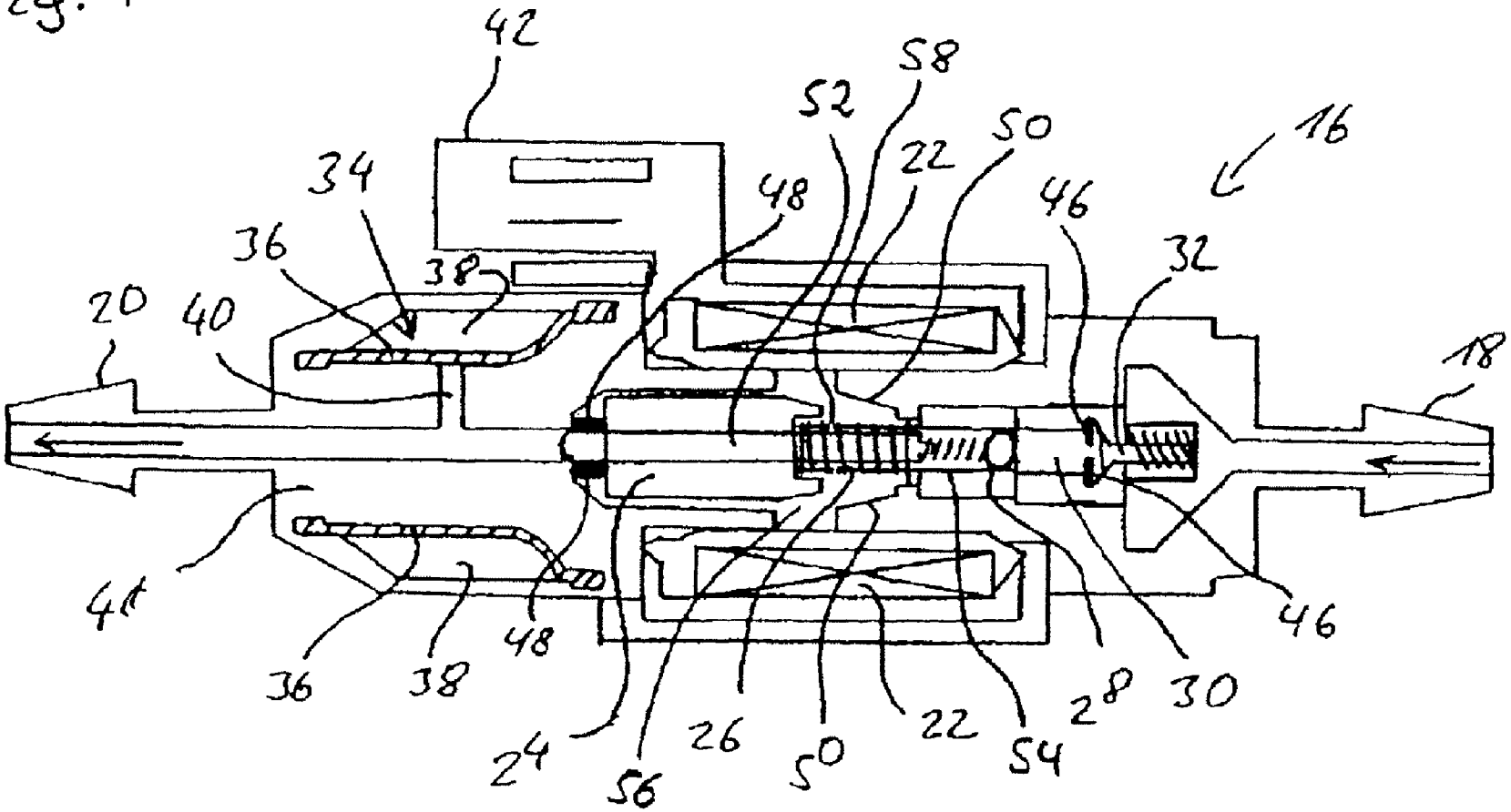
FIG. 1 shows a schematic side view through a reciprocating-piston pump.

The reciprocating-piston pump 16 illustrated in FIG. 1 is provided for feeding a liquid, for example fuel, in the direction indicated by the arrows from an inlet 18, which is connected to a reservoir, to an outlet 20, which is conventionally connected to a feed line. Below, "left" refers to the outlet side in drawing 1, and "right" refers to the inlet side of the reciprocating-piston pump.

The reciprocating-piston pump 16 comprises a restoring spring 26, a coil 22, an electrical connection 42, a replenishing valve 32, a feed chamber 30, a pump space 56, two impact dampers composed of elastomer 46, 48, a damping element 34 in a housing part 44, having an elastomer 36, having a chamber 38 and having a plurality of bores 40 distributed uniformly about the longitudinal axis of the reciprocating-piston pump 16, and a reciprocating piston 24, having a rod 52 which forms its central longitudinal axis, having a tube 54 which surrounds the rod 52 at the right-hand side of the reciprocating piston, and having a non-return valve 28 which is arranged at the right-hand end of the tube 54. The individual components of the reciprocating piston 24 are rigidly connected to one another; only the non-return valve 28 conventionally comprises moving parts. The tube 54 also has at least one bore 58 which connects the volume in the interior of the tube with the volume in the region of the core flange 50, and thereby permits a connection between the feed chamber 30 and the pump space 56 when the non-return valve 28 is open.

The feed cycle of the reciprocating-piston pump 16 can be divided into a feed phase and a replenishing phase, with FIG. 1 showing the state at the start of the feed phase. A voltage is applied in a suitable way to the electrical connection 42, as a result of which a coil 22 is supplied with current. The coil 22 builds up a magnetic field which sets the reciprocating piston 24 electromagnetically in motion to the right. Here, the reciprocating piston compresses the liquid present in the feed chamber 30 and the non-return valve 28 opens on account of the rising pressure. The liquid in the interior of the feed chamber can now flow through the interior of the tube 54, and through the bore 58 provided in the tube, into the region of the core flange 50. At the same time, the reciprocating piston 24 has opened the outlet 20 at the left-hand side, through which outlet 20 the liquid volume displaced in the feed chamber 30 can be discharged out of the reciprocating-piston pump 24. The reciprocating piston moves up to its right-hand stop point at the impact damper 46, wherein overall, the liquid volume present in the feed chamber 30 is fed into the pump space 56 and the feed phase is ended. In the feed phase, no liquid is discharged out of the outlet 20.

The replenishing phase begins as the supply of current to the coil 22 is ended. The restoring spring 26 presses the reciprocating piston 24 to the left. On account of the vacuum generated in the feed chamber 30, the non-return valve 28 closes and the replenishing valve 32 opens, whereby new liquid to be fed is sucked in through the inlet 18 and the feed chamber is re-filled. In this phase, liquid is discharged at the outlet 20, since the volume of the pump space 54 is reduced in size during the replenishing phase by the movement of the reciprocating piston 24. The feed phase ends when the reciprocating piston 24 has reached its illustrated starting position again and the feed chamber is completely filled. The kinetic energy of the reciprocating piston 24 at the end of the replenishing phase is absorbed by an impact damper composed of elastomer 48.

Depending on the temperature, it is now possible to distinguish between two cases. If the temperature is above the glass transition temperature of the impact damper 46 composed of elastomer, then the impact damper 46 can absorb the impact energy of the reciprocating piston 24 at the end of the feed phase with little noise. The noise damping of the reciprocating-piston pump 16 therefore operates in the known way.

However, if the temperature is below the glass transition temperature of the impact damper 46 composed of elastomer, then said impact damper 46 can no longer completely absorb the impact energy of the reciprocating piston 24 on account of its reduced elasticity. Without the optimization according to the invention, this manifests itself in a considerably louder impact noise of the reciprocating piston 24. The optimization can be provided in particular by reducing the gap width which is present between the core flange 50 and the reciprocating piston 24 at the end of the feed phase. "Gap width" is to be understood to mean the spacing between the core flange 50 and reciprocating piston 24 in the plane perpendicular to the movement direction. In order to benefit from the effect of hydraulic damping, the gap width in the radial direction between the reciprocating piston 24 and the core flange 50 at the end of the feed phase should be of the order of magnitude of 1.0 to 0.1 mm, preferably between 0.5 and 0.3 mm.

The reciprocating piston 24 is supplied with energy by means of the magnetic field of the coil 22, which energy is partially stored in the restoring spring 28, is partially also present as kinetic energy of the reciprocating piston, and is partially consumed in feeding the liquid. As a result of the movement of the reciprocating piston 24, the spacing between the core flange 50 and the reciprocating piston 24 decreases continuously over the course of the feed phase. In a late interval of the feed phase, shortly before the end of the feed phase, the liquid must be pressed through a gap which is then very narrow. As a result, a hydraulic pressure is generated in said region, which hydraulic pressure absorbs, and converts into heat, a further part of the kinetic energy of the reciprocating piston 24. The hydraulic pressure builds up as a result of the displacement of liquid from the region between the core flange 50 and the reciprocating piston 24 through the reciprocating piston 24. A liquid cushion is formed between the reciprocating piston 24 and the core flange 50, which liquid cushion brakes the movement of the reciprocating piston 24 additionally to the restoring spring. The build-up of the liquid cushion is contributed to in particular by that part of the liquid which is fed at the end of the feed phase from the feed chamber 30 into the pump space 56 and thereby emerges through the bore 58 out of the tube 54 into the region of the core flange 50. The intensity of said hydraulic pressure, and therefore the absorbed energy quantity, is highly dependent on the gap width in the plane perpendicular to the movement direction of the reciprocating piston 24 and on the viscosity of the liquid. With suitable dimensioning of the gap, it is therefore possible to obtain that, in a late interval of the feed phase, the movement energy of the reciprocating piston is converted into heat primarily by the hydraulic pressure. In a reciprocating-piston pump without the optimization according to the invention, it is also the case that, in a late interval of the feed phase, the hydraulic pressure is not dominant and less kinetic energy of the reciprocating piston is absorbed. The hydraulic damping thereby relieves the impact damper 46 of load, which need thereby absorb less kinetic energy. The impact noise of the reciprocating piston against the impact damper is in this way damped even at low temperatures. In particular, the intensity of the hydraulic damping increases with falling temperature, while the impact damper composed of elastomer 46 can absorb less kinetic energy because it hardens.

The hydraulic damping which brakes the reciprocating piston 24 does not adversely affect the operation of the reciprocating-piston pump because it is highly dependent on the viscosity of the liquid and can assume a relevant magnitude only shortly before the end stop is reached at the end of the feed phase.

Undesired pulsations in the feed line can be reduced by means of a damping element 34 which comprises an elastomer 36. For example, if liquid fuel passes through a bore 40 and comes into contact with the elastomer 36, the elastomer 36 expands into an adjacent chamber 38 provided in a housing part 44. Only a certain counterpressure of the liquid fuel is necessary for this purpose. Pulsations in the line can be damped by means of the elasticity of the elastomer 36.

Figure 2:
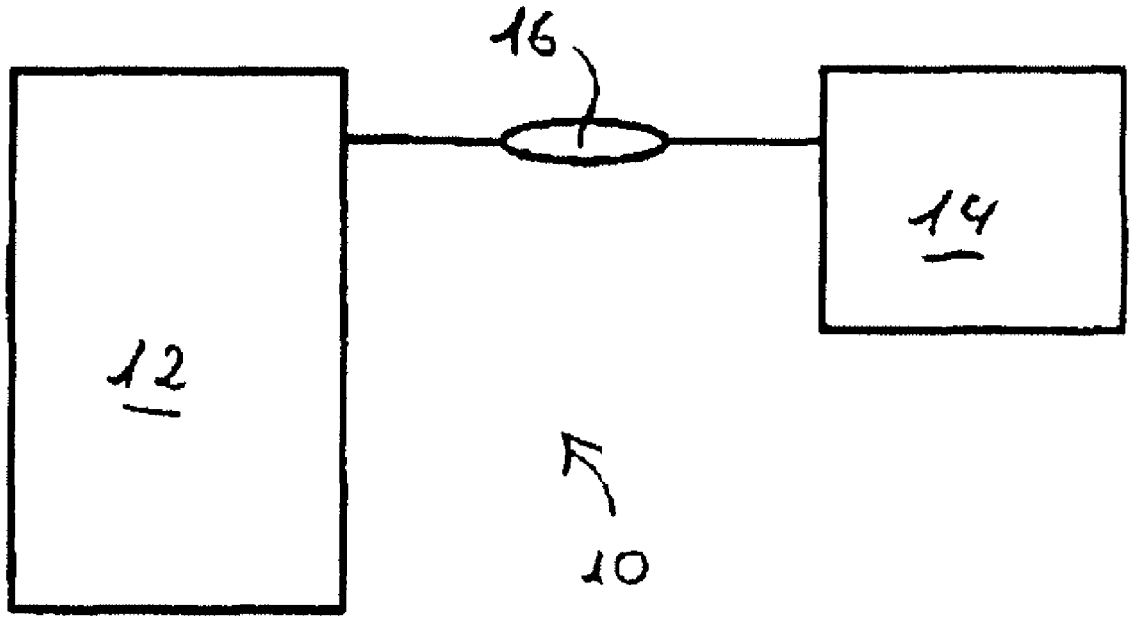
FIG. 2 shows a schematic block circuit diagram which shows a vehicle heater comprising the reciprocating-piston pump according to the invention.

FIG. 2 shows a schematic block circuit diagram which comprises a vehicle heater with a reciprocating-piston pump according to the invention. The illustrated vehicle heater 10 can for example be an auxiliary heater or standstill heater. Fuel is fed by the reciprocating-piston pump 16 from a fuel tank to a burner/heat-exchanger unit 14.

The features of the invention disclosed in the above description, in the drawings and in the claims can be essential to the realization of the invention both individually and also in any desired combination.

The invention claimed is:

1. Reciprocating-piston pump having an electromagnetically driveable reciprocating piston having an end surface, which is mounted with a restoring spring, for feeding a liquid, an impact damper composed of an elastomer for damping an impact of the reciprocating piston at the end of a feed phase, a core flange having a core flange surface which is situated opposite the reciprocating piston, with an optimized and substantially uniform gap dimension across the reciprocating piston end surface and core flange surface, which is dependent on the position of the reciprocating piston being provided between the reciprocating piston and the core flange, wherein the kinetic energy of the reciprocating piston during an early feed interval of a feed phase is absorbed primarily by the restoring spring and the feed of the liquid, wherein the kinetic energy of the reciprocating piston during a late feed interval of a feed phase is absorbed primarily by the hydraulic damping of the liquid present in the gap, and wherein the gap width between the reciprocating piston and core flange in the radial direction perpendicular to the axial movement direction of the reciprocating piston at the end of the feed phase is between 1.0 and 0.1 mm.

2. Reciprocating-piston pump of claim 1, characterized in that the gap provided between the core flange and the reciprocating piston is minimized in order to build up the hydraulic damping for braking the reciprocating piston before the latter comes into contact with the impact damper at its end stop at the end of the feed phase.

3. Reciprocating-piston pump of claim 1, characterized in that an impact damper composed of elastomer is provided for impact damping of the reciprocating piston at the end of a replenishing phase.

4. Reciprocating-piston pump of claim 1, characterized in that a damping element which comprises an elastomer is provided for damping pulsations generated in a feed line by the reciprocating-piston pump.

5. Reciprocating-piston pump of claim 1, characterized in that the gap width between the reciprocating piston and the core flange in the radial direction perpendicular to the axial movement direction of the reciprocating piston at the end of the feed phase is between 0.5 and 0.3 mm.

6. Motor vehicle heater, having a reciprocating-piston pump of claim 1 which is provided for feeding liquid fuel.

7. A method to determine the uniform gap of claim 1, comprising the step of determining an optimization value selected from a variable list consisting of:

noise abatement during an and stop of a fluid feed stage;

production tolerance to assure a gap remains between the piston and the flange at the end stop of the liquid feed stage;

fluid compression;

fluid viscosity;

a perpendicular plane of a movement direction of the reciprocating piston, ambient temperature, and kinetic heat transfer during compression.

* * * * *